US010765186B2

(12) United States Patent
Letendre et al.

(10) Patent No.: US 10,765,186 B2
(45) Date of Patent: Sep. 8, 2020

(54) CANOPY UMBRELLA WITH IMPROVED CONTROL

(71) Applicants: Roland Letendre, New Bedford, MA (US); Charles Taylor, New Bedford, MA (US)

(72) Inventors: Roland Letendre, New Bedford, MA (US); Charles Taylor, New Bedford, MA (US)

(73) Assignee: Niche Inc., New Bedford, MA (US)

( * ) Notice: Subject to any disclaimer, the term of this patent is extended or adjusted under 35 U.S.C. 154(b) by 0 days.

(21) Appl. No.: 16/256,253

(22) Filed: Jan. 24, 2019

(65) Prior Publication Data

US 2019/0150577 A1 May 23, 2019

Related U.S. Application Data

(63) Continuation-in-part of application No. 15/201,587, filed on Jul. 4, 2016, now abandoned.

(51) Int. Cl.

| | |
|---|---|
| ***A45B 25/10*** | (2006.01) |
| ***A45B 25/14*** | (2006.01) |
| ***A45B 23/00*** | (2006.01) |
| ***E04H 15/28*** | (2006.01) |

(52) U.S. Cl.

CPC ..... *A45B 25/14* (2013.01); *A45B 23/00* (2013.01); *A45B 25/10* (2013.01); *E04H 15/28* (2013.01); *A45B 2023/0012* (2013.01)

(58) Field of Classification Search

CPC ..... A45B 25/08; A45B 25/10; A45B 25/14; A45B 2025/105

USPC ..... 135/19.5, 28, 38

See application file for complete search history.

(56) References Cited

U.S. PATENT DOCUMENTS

| | | | | | |
|---|---|---|---|---|---|
| 462,171 | A * | 10/1891 | Smith | A45B 25/06 | 135/28 |
| 2,867,875 | A * | 1/1959 | Davison | F16G 11/106 | 24/133 |
| 4,422,467 | A * | 12/1983 | Wu | A45B 25/10 | 135/33.6 |
| 4,912,817 | A * | 4/1990 | Sandreid | F16G 11/101 | 24/132 R |
| 5,020,557 | A * | 6/1991 | Apple | A45B 23/00 | 135/15.1 |
| 5,758,678 | A * | 6/1998 | Wu | A45B 25/10 | 135/33.41 |
| 6,173,721 | B1 * | 1/2001 | Mery | A45B 25/14 | 135/16 |
| 7,028,699 | B2 * | 4/2006 | Lee | A45B 17/00 | 135/19.5 |
| 2002/0046761 | A1 * | 4/2002 | Liang | A45B 25/14 | 135/16 |

FOREIGN PATENT DOCUMENTS

| | | | | |
|---|---|---|---|---|
| WO | WO-9956035 | A1 * | 11/1999 | B63B 21/04 |

* cited by examiner

*Primary Examiner* — Noah Chandler Hawk

(57) ABSTRACT

An umbrella having a quick release finial and a quick release cam cleat assembly is provided. The quick release finial includes a ball plunger assembly and a lever arm for applying force to release the ball plunger. The quick release cam cleat assembly includes a pivotable cam cleat and a pivotable gravity lock rocker arm.

15 Claims, 12 Drawing Sheets

CANOPY UMBRELLA WITH IMPROVED CONTROL

CROSS-REFERENCE TO RELATED APPLICATIONS

The present application is related to, claims the earliest available effective filing date(s) from (e.g., claims earliest available priority dates for other than provisional patent applications; claims benefits under 35 USC § 119(e) for provisional patent applications), and incorporates by reference in its entirety all subject matter of the following listed application(s) (the "Related Applications") to the extent such subject matter is not inconsistent herewith; the present application also claims the earliest available effective filing date(s) from, and also incorporates by reference in its entirety all subject matter of any and all parent, grandparent, great-grandparent, etc. applications of the Related Application(s) to the extent such subject matter is not inconsistent herewith:

This application is a continuation-in-part of U.S. patent application Ser. No. 15/201,587 entitled "CANOPY UMBRELLA WITH IMPROVED CONTROL", naming Roland Letendre and Charles Taylor as inventors, filed 4 Jul. 2016.

BACKGROUND

1. Field of Use

This invention relates to an improved apparatus for garden and porch umbrellas suited for outdoor patio and recreational furniture use, particularly those units expected to opened and closed at frequent intervals.

2. Description of Prior Art (Background)

Outdoor umbrellas, sometimes called porch or pool umbrellas, are most often constructed with a central post and rigidly attached canopy assembly that may be opened or closed as desired. The central post is either fixed to a supporting base or free to rotate within the constraints of a supporting base. Outdoor umbrellas are typically six feet or more in diameter when opened to its operating position.

An outdoor umbrella exposed to severe winds in its open position results in large unstable forces applied to the canopy assembly. These forces are capable of producing unfavorable strains within both the canopy assembly and central post. An umbrella design incorporating a fixed central post and rigidly attached canopy assembly offers no relief from these internal strains. Allowing the central post and attached canopy assembly to rotate as one component converts this wind energy into rotational energy and reduces these internal strains.

Furthermore, a conventional garden umbrella generally includes a pole with a top hub which provides a pivot connection for upper support ribs, and upper and lower runners which are sleeved slidably on the pole and which provide a pivot connection for lower support ribs and stretchers. The stretchers are attached pivotally to the lower support ribs. A plurality of connecting rods interconnect the upper and lower support ribs. During stretching operation, the stretchers are moved upward by upward movement of the lower runner to stretch the lower support ribs. Consequently, the upper support ribs are actuated to spread by the connecting rods.

Prior art solutions often require the top hub be secured to the umbrella pole with a threaded bolt requiring tools to attach the top hub to the pole. Thus, when preparing for inclement weather tools and some amount of time are required to disassemble the umbrella.

Prior art solutions using a rope and pulley system to open the umbrella often employ the use of rotatable cam shaped gear members configured to engage the rope to hold the umbrella in an open position. However, these types of rope engagement systems require manual dexterity to wedge the rope between the cam members for the cam members to engage the rope and visual confirmation that the rope is full wedged between the cam members. Often the rope may not be full engaged due to the user being unable to see if the rope is fully wedged between the cam members due to: bright sunlight, the user wearing sun glasses, umbrella shadows, etc. If the rope is not fully engaged this can lead to a dangerous condition if the rope becomes disengaged from the cam members resulting in an unexpected collapse of the outdoor umbrella.

Often, prior art solutions using cam shaped gear members require the user to have the manual dexterity and mindset required to interact with the rope and cam shaped gear members to either engage or disengage the rope from the gear members. For example, U.S. Patent Application Publication No. US2011/0017249 requires the user to gently urge the rope such that the rope is engaged by the engagement system. Similarly, U.S. Patent Application Publication No. US2011/0017249 discloses that the user may need to pull the rope radially outward so as to urge the rope towards an engagement zone. It will be appreciated that users employing a beach umbrella may not readily understand that they need to pull a rope radially and often lack the patience required to urge the rope to the desired position.

There exists a need, therefore, for an umbrella deployment system having a rapid engagement/disengagement system to facilitate the opening and closing of the umbrella. There is also a need for the rapid engagement/disengagement system to be quickly and intuitively operated by a user without the need for a user to urge an engagement of the rope or for the user to have to guess which way to pull the rope for the system to either engage or disengage the rope.

In addition, there exists a need for a top hub of the umbrella be readily and easily removable to facilitate quick disassembly of the umbrella.

BRIEF SUMMARY

The foregoing and other problems are overcome, and other advantages are realized, in accordance with the presently preferred embodiments of these teachings. One embodiment of the present invention is designed to address these and other needs relates primarily to an outdoor umbrella having a rapid engagement/disengagement of a mechanical advantage to facilitate the opening and closing of the umbrella; adjusted to various desired positions; and reliably maintained in place.

Accordingly, and as explained more in detail subsequently herein, the present invention includes at least one hub member mounted to an umbrella pole member and slidable between the top and bottom ends thereof. In one embodiment, the invention comprises a pair of hub members, namely, one secured to the pole member near the top end thereof and a main hub member movably secured about the pole member and slidable there along to open and close the umbrella canopy.

In addition, the hub members are mounted on the umbrella pole member so as to both be rotatable about the pole, and to generally assist in the smooth operation of the umbrella frame. The hub members are easily mounted to and can be easily removed from the umbrella pole member for repair and/or for replacement, if necessary by a quick release finial.

An embodiment of the invention includes a mechanical operating system to allow the umbrella to be adjusted to almost any degree of openness and simply locked or otherwise maintained in place. In one embodiment, the operating system comprises but is not limited to a pulley system connecting or interconnected with the hub members and structured to move the main hub member up and down a length of the pole towards the top end of the pole.

The invention is also directed towards an umbrella, assembly having a quick release finial, wherein the quick release finial includes a finial top; a finial tower connected to the finial top; and a non-threaded finial post connected to the final tower. The non-threaded finial post includes at least one ball plunger assembly. The umbrella assembly also includes a finial insert having a non-threaded bore hole adapted to snugly receive the finial post; and a bottom surface for engaging the at least one ball plunger assembly.

Another embodiment of the invention includes an umbrella apparatus having an umbrella; a pole; a top hub; a slidable hub having a hole suitable for sliding the slidable hub along the pole; and a plurality of rib members connectable to the umbrella and the top hub. The apparatus also includes a plurality of pivotable struts disposed, one-to-one, between the slidable hub and the plurality of rib members. In addition, the apparatus includes a finial top adaptable to allow comfortable hand held grasping. The finial top includes a finial tower and a non-threaded finial post having at least one ball plunger assembly.

The invention is also directed towards an umbrella system having a quick releaser cam cleat assembly. The quick releaser cam cleat assembly includes a stationary bottom grip; a top grip pivot post; a top grip cam pivotable on the top grip pivot post; a rocker arm pivot post; a rocker arm pivotable on the rocker arm pivot post; and a mounting base for mounting the bottom grip and the rocker arm pivot post. The top grip cam and the rocker arm pivot to engage and hold a line between the stationary bottom grip and the top grip cam. The umbrella system also includes a finial top adaptable to allow comfortable hand held grasping. The finial top includes a finial tower; a finial post having at least one ball plunger assembly. The umbrella system also includes a finial insert having a non-threaded bore hole adapted to snugly receive the finial post; and a bottom surface for engaging the at least one ball plunger assembly.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

The following brief definition of terms shall apply throughout, the application:

The term "comprising" means including but not limited to, and should be interpreted in the manner it is typically used in the patent context;

The phrases "in one embodiment," "according, to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example; and If the specification states a component or feature "may," "can," "could," "should," "preferably," "possibly," "typically," "optionally," "for example," or "might" (or other such language) be included or have a characteristic, that particular component or feature is not required to be included or to have the characteristic.

Figure 1:
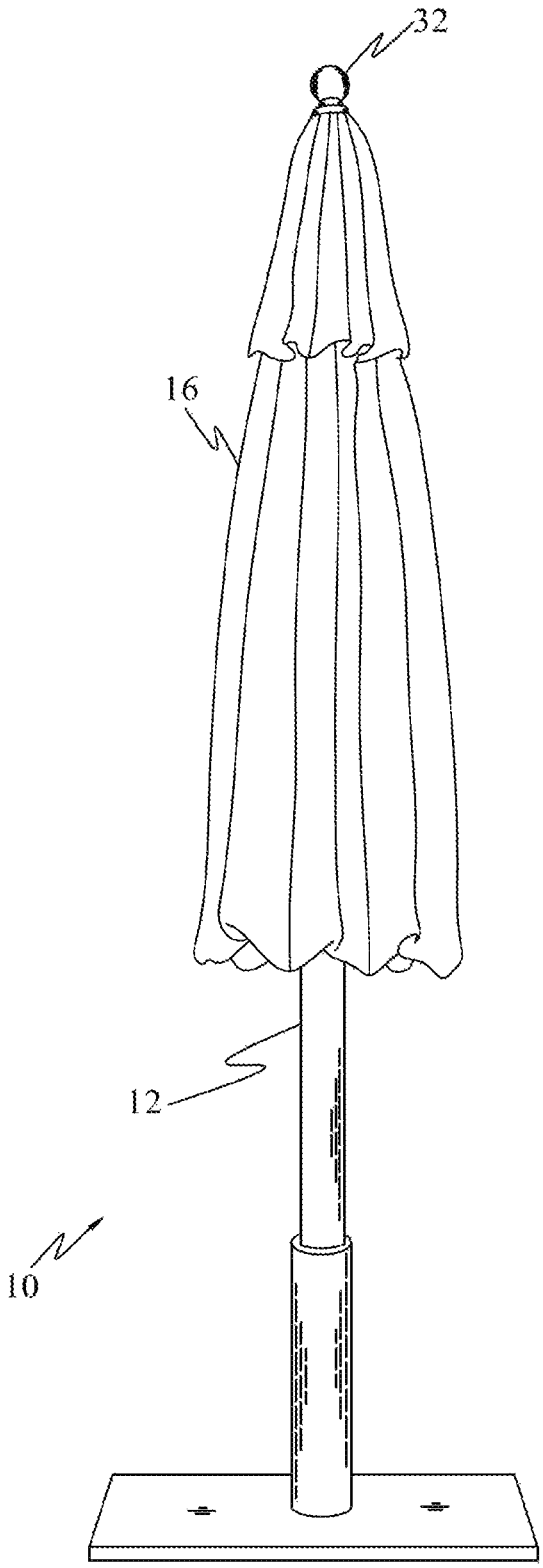
FIG. 1 is a pictorial illustration of an umbrella in a closed position in which features of the invention are implemented.

Referring to FIG. 1 there is shown a pictorial illustration of an umbrella 10 in a closed position in which features of the invention are implemented. Umbrella 10 includes pole 12, umbrella shade 16, and quick release finial 32.

Figure 2:
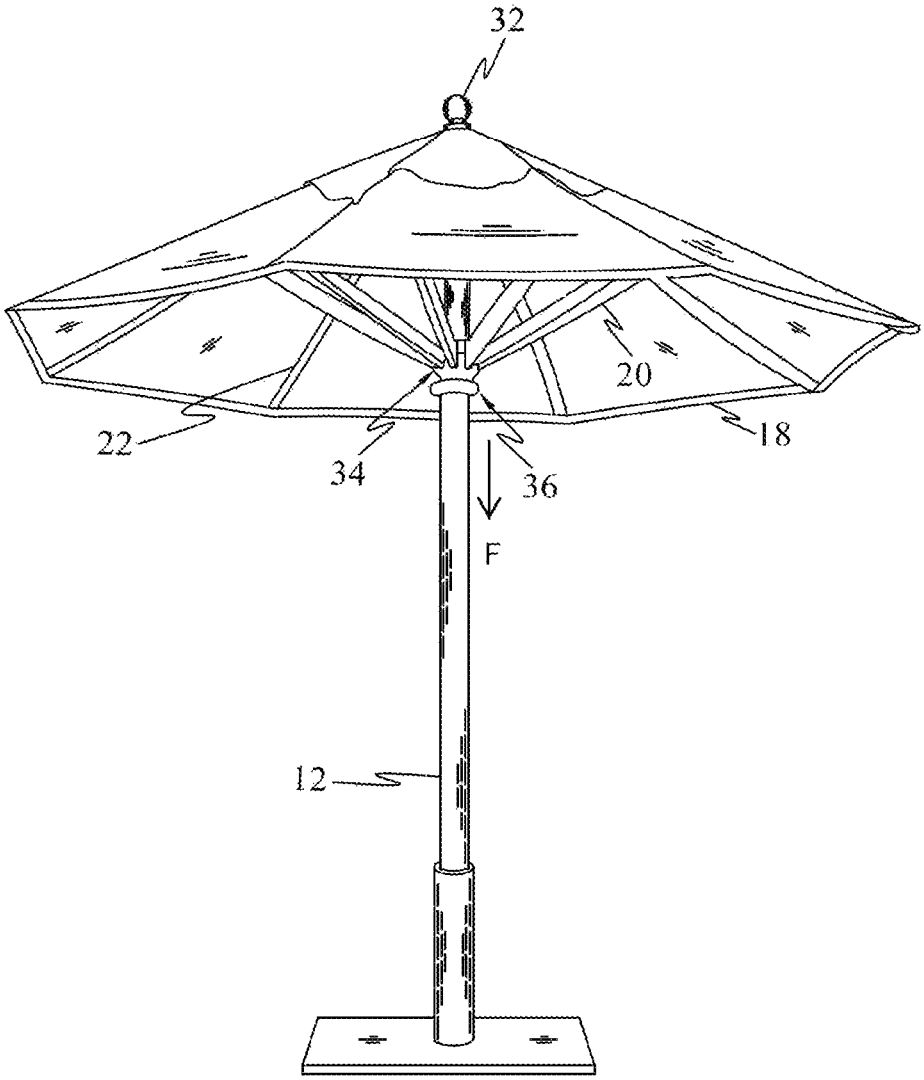
FIG. 2 is a pictorial illustration of the umbrella in an open position in accordance with the invention shown in FIG. 1.

Referring also to FIG. 2 there is shown a pictorial illustration of the umbrella in an open position in accordance with the invention shown in FIG. 1. In the open position rib members 22, pivotable rigid struts 20 and slidable hub 36 are visible. It will be appreciated umbrella shade 18 is opened when slidable hub 36 is pushed upwards on pole 12 which in turn pushes one end of struts 20, which are pivotable at the hub 36 strut end connection points 34. As struts ends 34 are pushed upwards the other end of the struts 20 connected to ribs 22 push, or lift, the ribs upwards and outwards to open the umbrella. It will be appreciated that the force required to open the umbrella 10 will require sufficient force to push hub 36 upwards to simultaneously lift all rib members 22. Depending on weather conditions, the number of rib members, and other factors, this could be a difficult task without a mechanical advantage.

Figure 3:
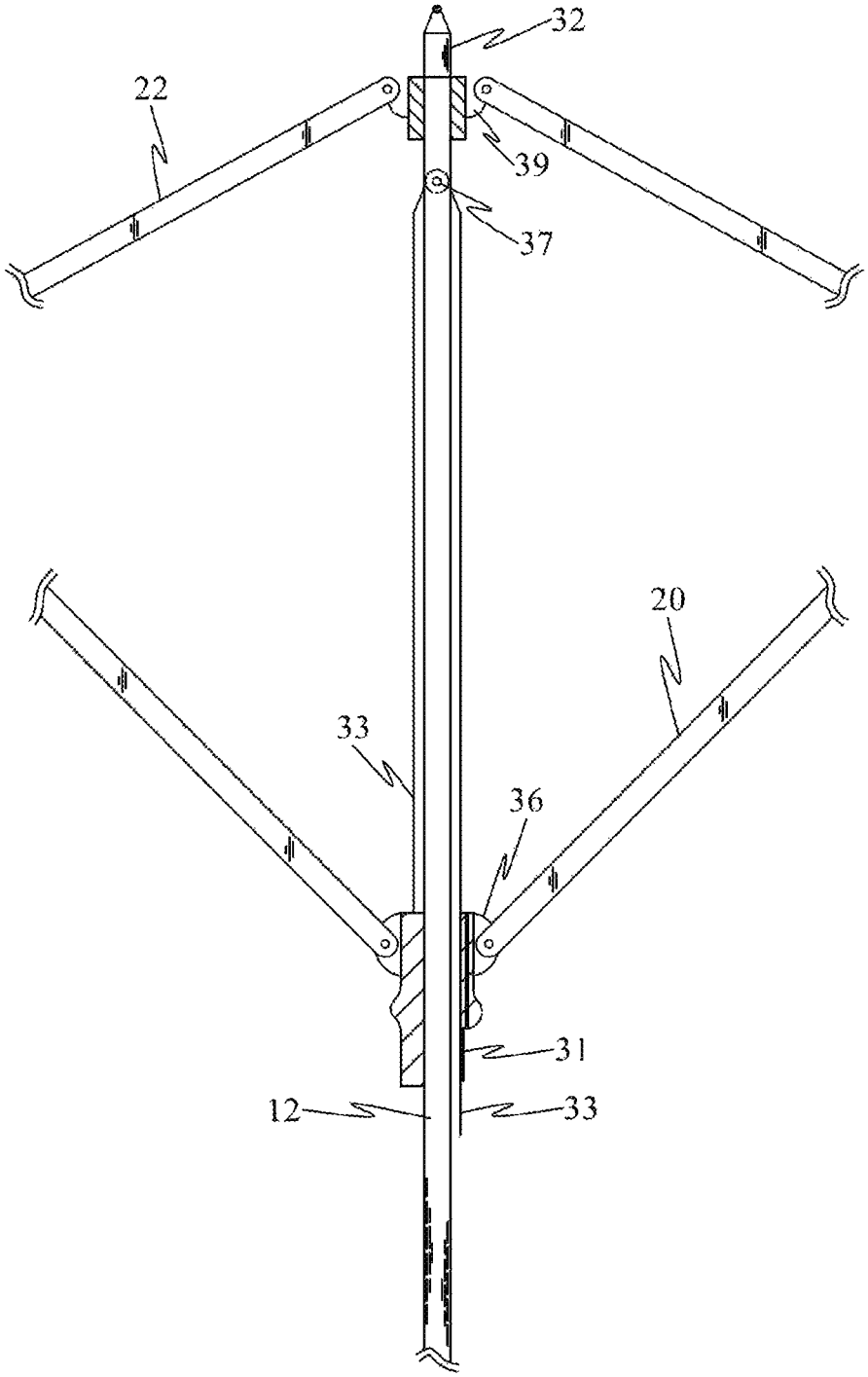
FIG. 3 is a pictorial illustration of the umbrella illustrating quick release mechanical advantage features and quick release finial in accordance with the invention shown in FIG. 1.

Referring also to FIG. 3 there is shown a pictorial illustration of the umbrella illustrating quick release mechanical advantage features and quick release finial in accordance with the invention shown in FIG. 1. The quick release mechanical advantage features include quick releaser 31 (shown in more detailed later), line or rope 33, and mechanical advantage system 37. Mechanical advantage system 37 may be any suitable mechanical advantage system such as, but not limited to, a pulley based mechanical advantage system. A pulley based mechanical advantage system is determined according to the mechanical advantage (MA) desired formula, e.g., MA=2n, where n equals the number of pulleys.

Still referring to FIG. 3, line 33 is threaded through quick releaser 31 (shown in more detail later) and mechanical advantage system 37 and secured to hub 36. In release mode line 33 is pulled downwards, and through a mechanical advantage pulls hub 36 upwards, thereby opening the umbrella as described earlier. In hold mode the quick releaser 31 holds the line 33 in place.

Also shown in FIG. 3 is quick release finial 32 (shown in more detail later). Quick release finial 32 is removed to allow slidable hubs 36, 39 to be easily removed for repair of the hubs 36, 39 and/or rib members 22 and/or struts 20.

Figure 4:
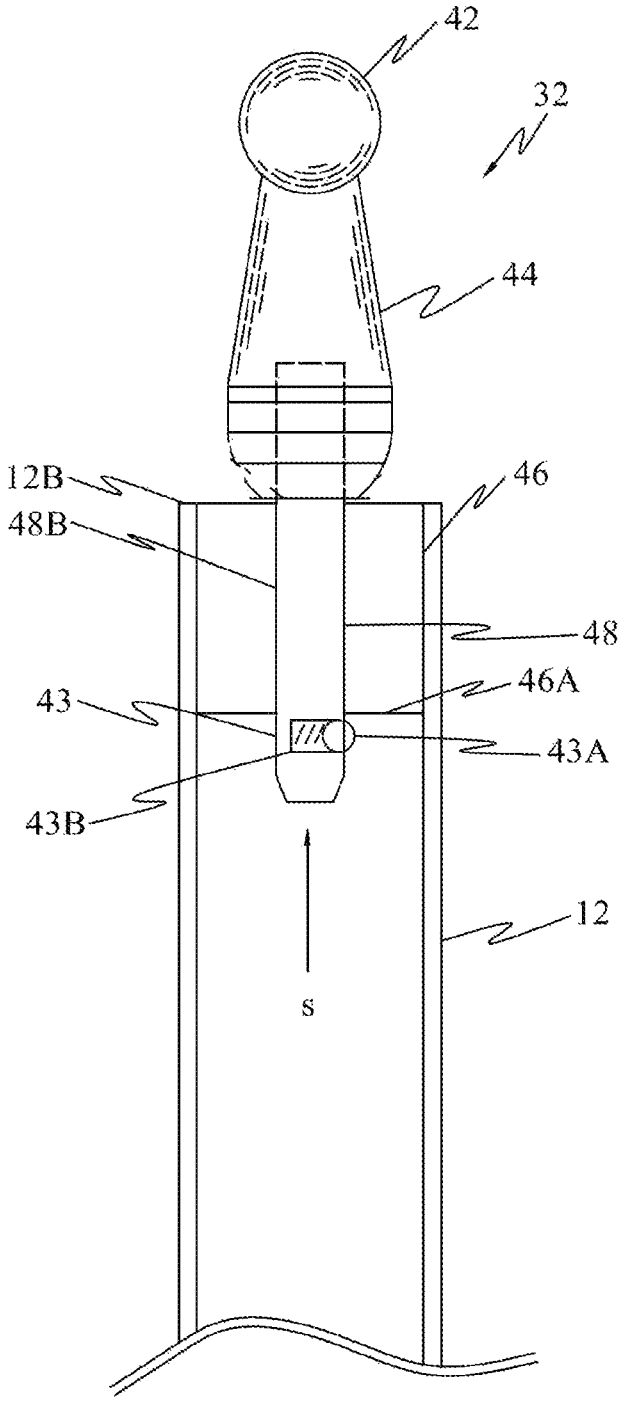
FIG. 4 is an exploded pictorial illustration of the quick release finial feature in accordance with the invention shown in FIG. 3.

Referring also to FIG. 4 there is shown an exploded pictorial illustration of the quick release finial assembly 32 in accordance with the invention shown in FIG. 3. Quick release finial includes finial top 42, finial tower 44, finial post 48, and finial insert 46. Finial post 48 includes ball plunger assembly 43 comprising spring 43B, and ball 43A.

Still referring to FIG. 4, finial insert 46 is adapted to compression fit into pole 12 having a bore hole 12B suitable to receive finial insert 46. It will be appreciated that finial insert 46 may be any suitable shape such as for example a tubular shape or a square shape having a suitable bore hole 48B adaptable to snugly receive finial post 48. Finial insert 46 includes a hole or bore having a diameter to fit, snugly, finial post 48. It will be appreciated that finial insert 46 may be any suitable shape such as for example a tubular shape or a square shape having a suitable bore hole adaptable to snugly receive finial post 48.

Finial post 48 includes ball plunger assembly 43 having spring 43B and ball 43A. Ball plunger assembly holds finial assembly 32 in place until enough force (break away force S) is applied in an upwards direction causing ball 43A to compress spring 43B to allow finial assemble 32 to be removed from finial insert 46. It will be appreciated that final post 48 and finial insert 46 are not threaded thus allowing for quick removal of the final post 48 from insert 46.

It will also be appreciated that bore hole 48B is of sufficient length to allow ball plunger assembly 43 to be substantially adjacent to the bottom outside surface 46A of finial insert 46 when the finial post 48 is fully inserted thus locking the quick release finial assembly 32 in place.

Figure 5:
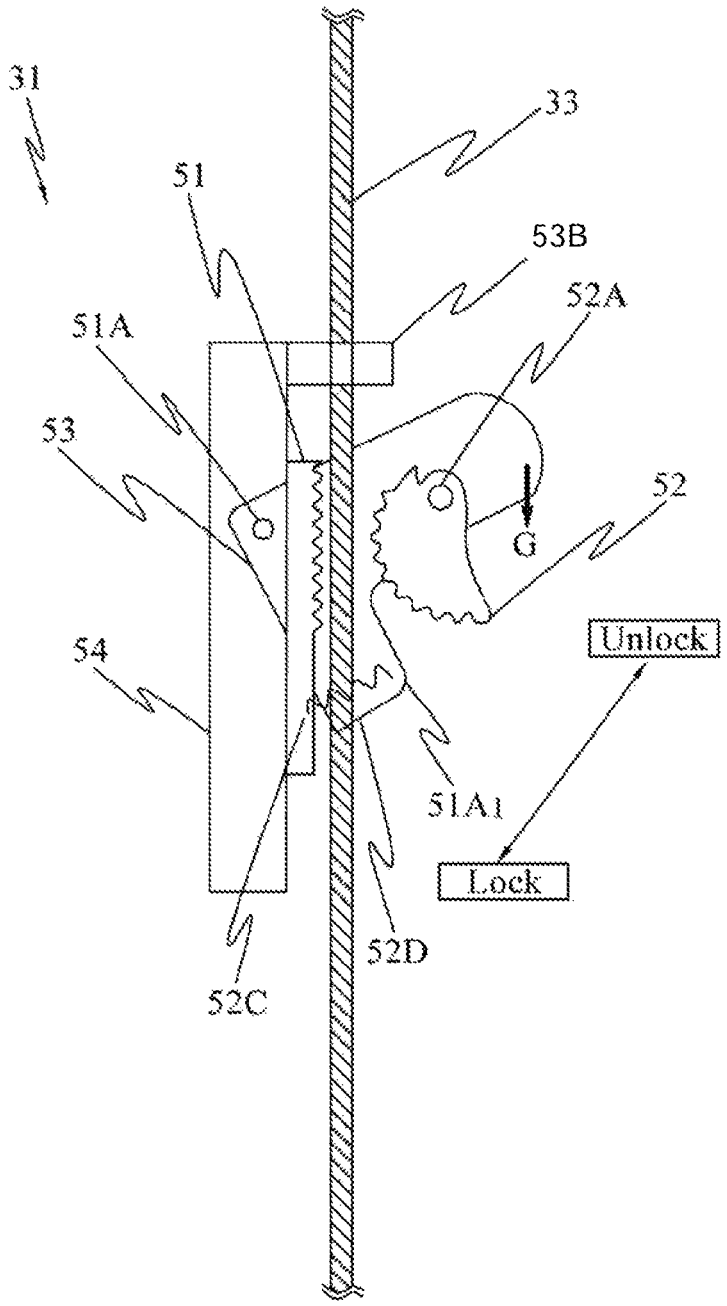
FIG. 5 is an exploded pictorial illustration of the quick releaser cam cleat in accordance with the invention shown in FIG. 3.

Referring also to FIG. 5 there is shown an exploded pictorial illustration of the quick releaser cam cleat assembly 31 in accordance with the invention shown in FIG. 3. Quick releaser cam cleat assembly 31 includes stationary bottom grip 51, pivotable top grip cam 52, top grip pivot post 52A, rocker arm 53, rocker arm pivot post 51A, and mounting base 54.

When an upward unlock force is applied to rope or line 33 (e.g., a user tugs on line or rope 33) and the quick releaser cam cleat assembly 31 is in the lock position the upward force operates to rotate rocker arm 53 in a counter clockwise rotation thereby disengaging the top grip cam cleat 52 allowing line 33 to pass freely through the quick releaser cam cleat assembly 31.

Still referring to FIG. 5, when, a locking force is applied to line 33 the quick releaser cam cleat assembly 31 is in the unlock position. The locking force rotates top grip cam cleat 52 on top grip pivot post 52A and rocker arm 53 on rocker arm pivot post 51A in a clockwise (as shown in FIG. 5) rotation. The clockwise rotation of top grip cam cleat 52 grips and holds line 33 between top grip cam cleat 52 and stationary bottom grip 51. It will be appreciated that the quick releaser cam cleat assembly is normally in the lock position due to the rocker arm 53 pivoting (due to gravity force G) in a clockwise rotation around rocker arm pivot post 51A, i.e., gravity locked. In alternate embodiments rocker arm 53 is counter weighted (e.g., weighted towards an end distal from the pivot point) to facilitate gravity lock and spring loaded with gravity assist spring 52C to facilitate gravity lock. Gravity assist spring is connected between stationary bottom grip 51 and rocker arm 53 Rocker arm pivot post 51A may be oval or cam shaped to facilitate the rocker arm staying in an open position when the quick releaser cam cleat assembly 31 is in, the unlock position.

Still referring to FIG. 5 it will be appreciated that rope guides 53B and 52D align the rope 33 through and within the engagement area between the top grip 52 and the stationary bottom grip 51. Thus, when in the quick releaser cam cleat assembly 31 is in the lock position the rope 33 is fully engaged by design and not left to the user to ascertain if the rope 33 is fully engaged. In addition, rope guide 52D provides a rope leverage surface 51A1 to facilitate rope 33 pivoting rocker arm 53 around pivot post 51A when unlocking or locking the quick releaser cam cleat assembly 31 (See also FIG. 8.)

Figure 6:
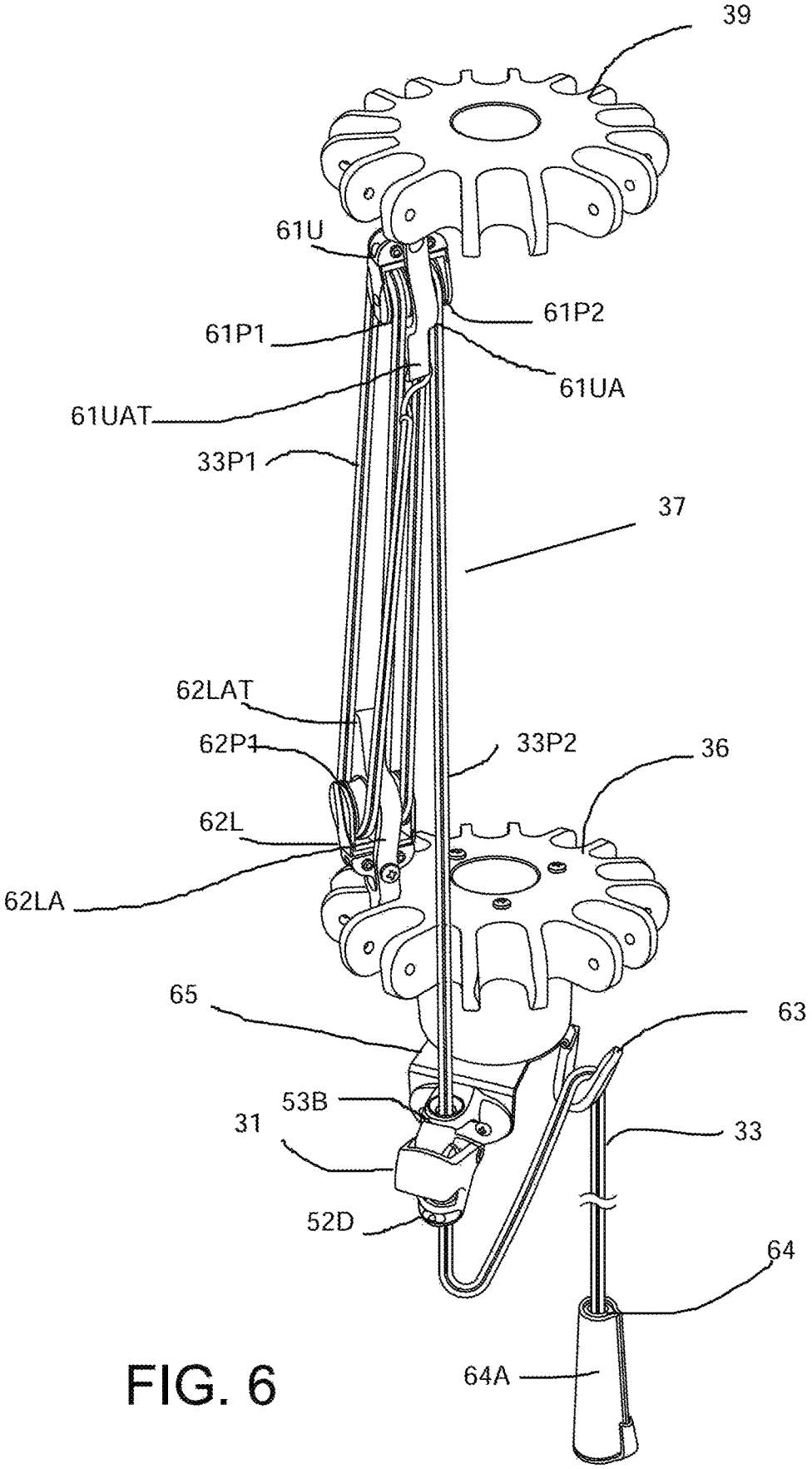
FIG. 6 is an exploded view of the upper and lower hub connected by the mechanical advantage system in accordance with the invention shown in FIG. 3.

Referring also to FIG. 6 there is a shown an exploded view of the upper hub 39 and lower hub 36 connected by the mechanical advantage system 37 in accordance with the invention shown in FIG. 3. The mechanical advantage system 37 includes upper dual pulley bracket 61U, upper line separator pulley bracket 61UA, pulley 61P1, pulley 61P2, and line 33. The mechanical advantage system also includes lower dual pulley bracket 62L, lower line separator pulley bracket 62UA, pulley 62P1, pulley 62P2.

As shown in FIG. 6, and in more detail herein, the upper putties 61P1 and 61P2 are disposed within dual pulley bracket 61U which is disposed within the upper line separator pulley bracket 61UA which is attached to upper hub 39. It will be appreciated that each of the pullies 61P1 and 61P2 are disposed to either side of upper line separator pulley bracket 61UA and that upper line separator pulley bracket 61UA includes an anti-fouling line separator tongue 61UAT for maintaining a separation between line 33P1 as it traverses pulley 61P1 and line 33P2 as it traverses pulley 61P2.

Similarly, still referring to FIG. 6, the lower putties 62P1 and 62P2 are disposed within dual pulley bracket 62U which is disposed within the lower line separator pulley bracket 62UA which is attached to lower hub 36. It will be appreciated that each of the pullies 62P1 and 62P2 are disposed to either side of lower line separator pulley bracket 62UA and that lower line separator pulley bracket 62UA includes an anti-fouling line separator tongue 62UAT for maintaining a separation between line 33P1 as it traverses pulley 62P1 and line 33P2 as it traverses pulley 62P2.

Figure 6A:
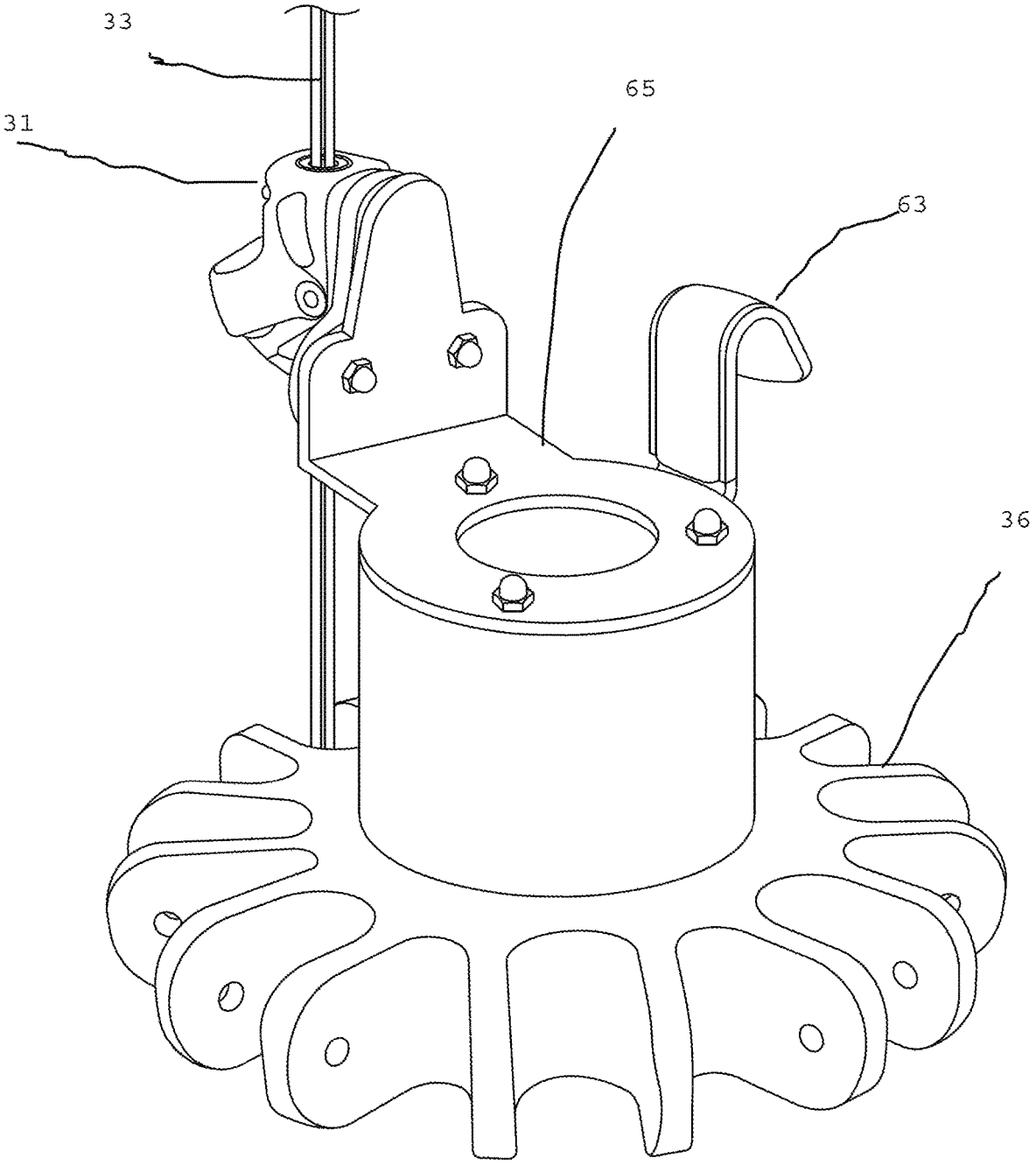
FIG. 6A is a pictorial view of the underside of the lower hub shown in FIG. 6.

Still referring to FIG. 6 there is shown quick releaser cam cleat assembly 31 attached to pressure bracket 65. As shown in FIG. 6A, pressure bracket 65 distributes the weight (force F shown in FIG. 2) transmitted by line 33 to quick releaser cam cleat assembly 31 around the underside of lower hub 36 when the umbrella 10 is in an open position. It will be appreciated that the distribution of force around hub 36 helps prevent excessive wear and tear on one side of hub 36 and provides a more secure upwards hold than if the quick releaser cam cleat assembly 31 were just mounted to the side of lower hub 36.

Still referring to FIG. 6 there is shown line retainer 63 for spooling or looping excess line when the umbrella 10 is in the open position. Also shown in FIG. 6 is weighted line pull 64. Weighted line pull 64 may be enclosed in absorbing material 64A to minimize noise between weighted line pull 64 and pole 12.

Figure 7:
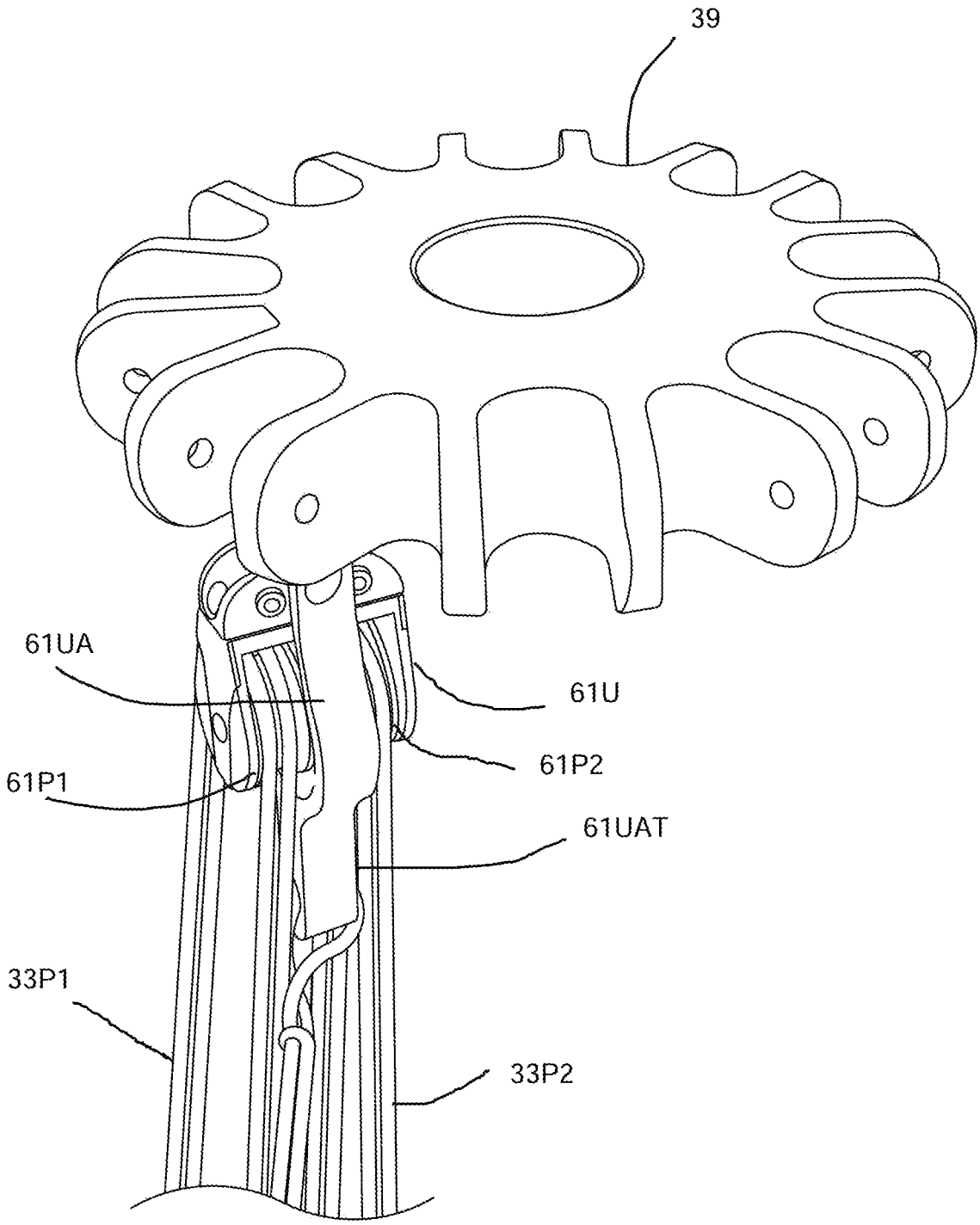
FIG. 7 is an exploded view of the upper hub, the upper dual pulley bracket, and the upper line separator pulley bracket in accordance with the invention shown in FIG. 6.

Referring also to FIG. 7 there is shown an exploded view of the upper hub 39, the upper pulley bracket 61U, the upper line separator pulley bracket 61UA in accordance with the invention shown in FIG. 6. Also shown in FIG. 7 is anti-fouling line separator tongue 61UAT for maintaining a separation between line 33P1 as it traverses pulley 61P1 and line 33P2 as it traverses pulley 61P2.

Figure 8:
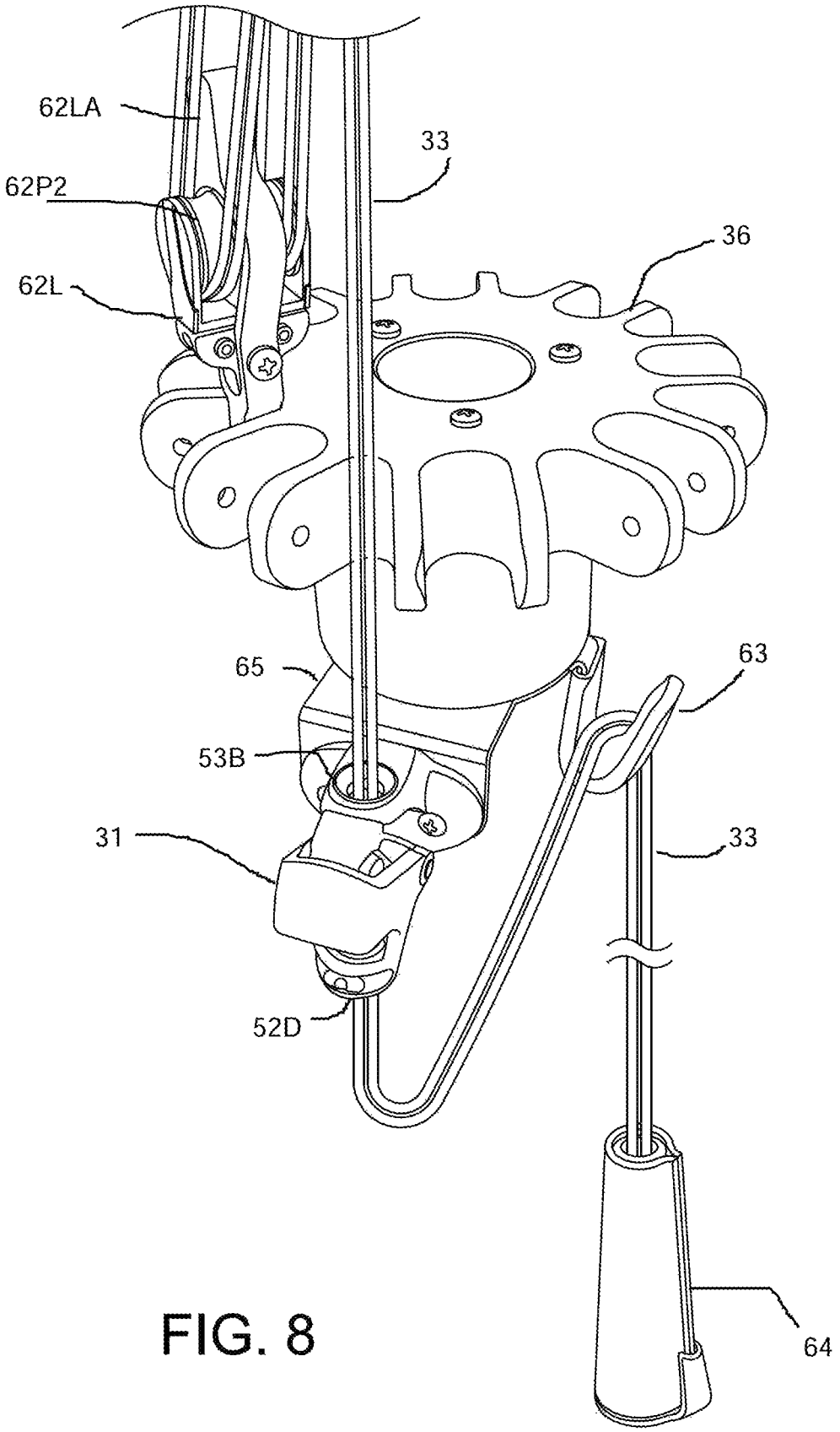
FIG. 8 is an exploded view of the lower hub, the lower dual pulley bracket, and the upper line separator pulley bracket in accordance with the invention shown in FIG. 6.

Referring also to FIG. 8 there is shown an exploded view of the lower hub 36, the lower pulley bracket 62L, and the lower line separator pulley bracket 62UA in accordance with the invention shown in FIG. 6. Also shown in FIG. 8 is anti-fouling line separator tongue 62UAT for maintaining a separation between line 33P1 as it traverses pulley 62P1 and line 33P2 as it traverses pulley 62P2.

Figure 9:
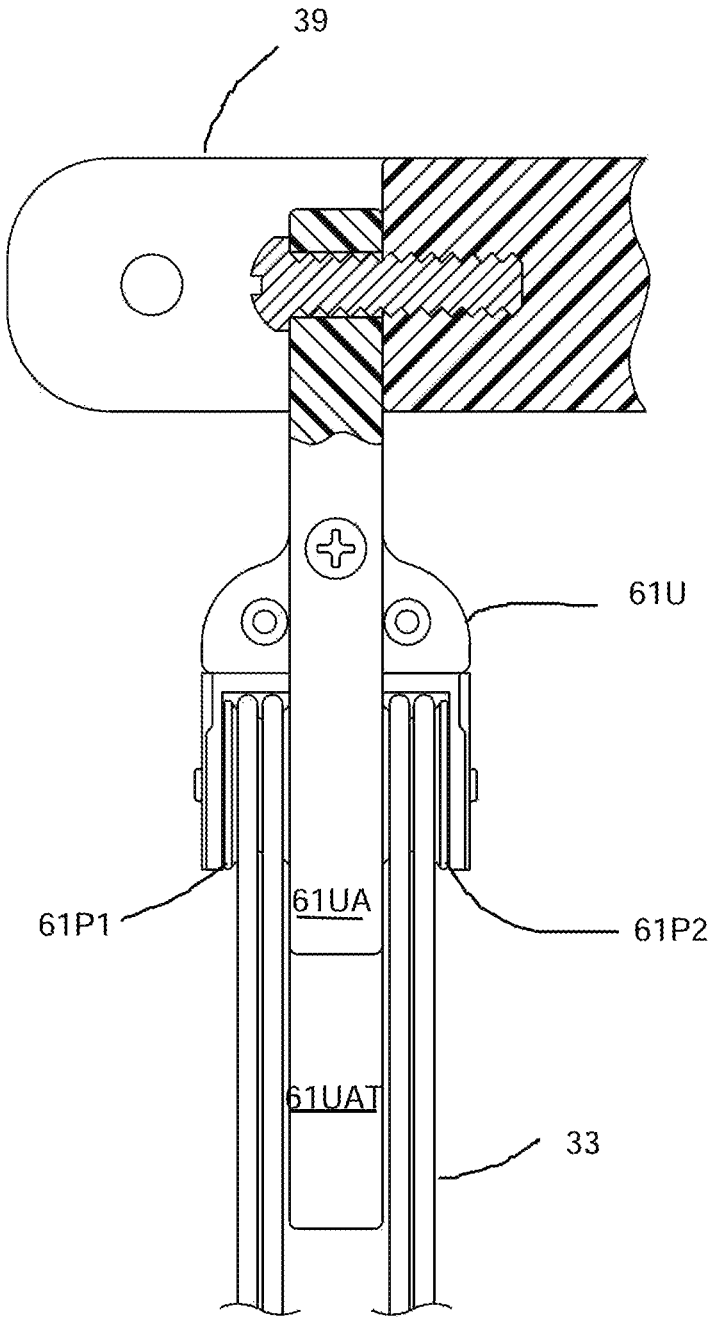
FIG. 9 is a frontal view of the upper dual pulley bracket and the line separator pulley bracket in accordance with the invention shown in FIG. 6.

Referring also to FIG. 9 there is shown a frontal view of the upper pulley bracket 61U and the line separator pulley bracket 61UA in accordance with the invention shown in FIG. 6. Also shown in FIG. 10 is anti-fouling line separator tongue 61UAT.

Figure 10:
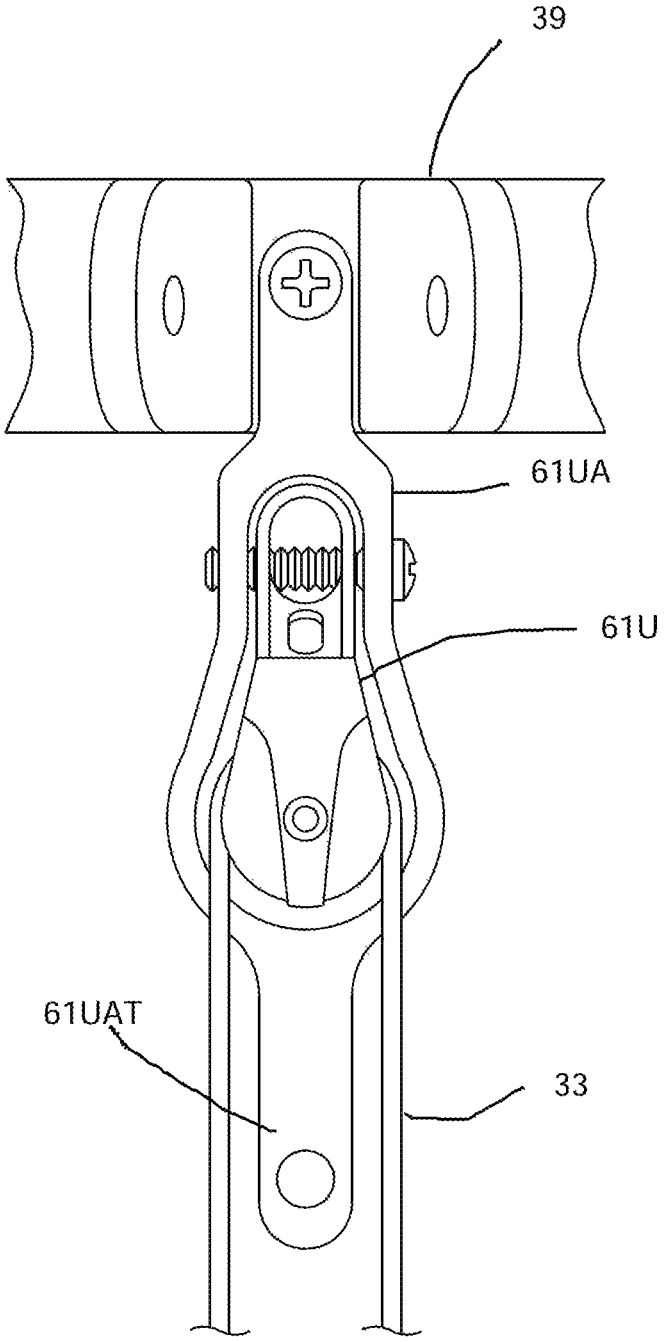
FIG. 10 is a side view of the upper dual pulley bracket and line separator pulley bracket in accordance with the invention shown in FIG. 6.

Referring also to FIG. 10 there is shown a side view of the upper pulley bracket 61U and line separator pulley bracket 61UA attached to upper hub 39 in accordance with the invention shown in FIG. 6. Also shown in FIG. 10 is anti-fouling line separator tongue 61UAT.

Figure 11:
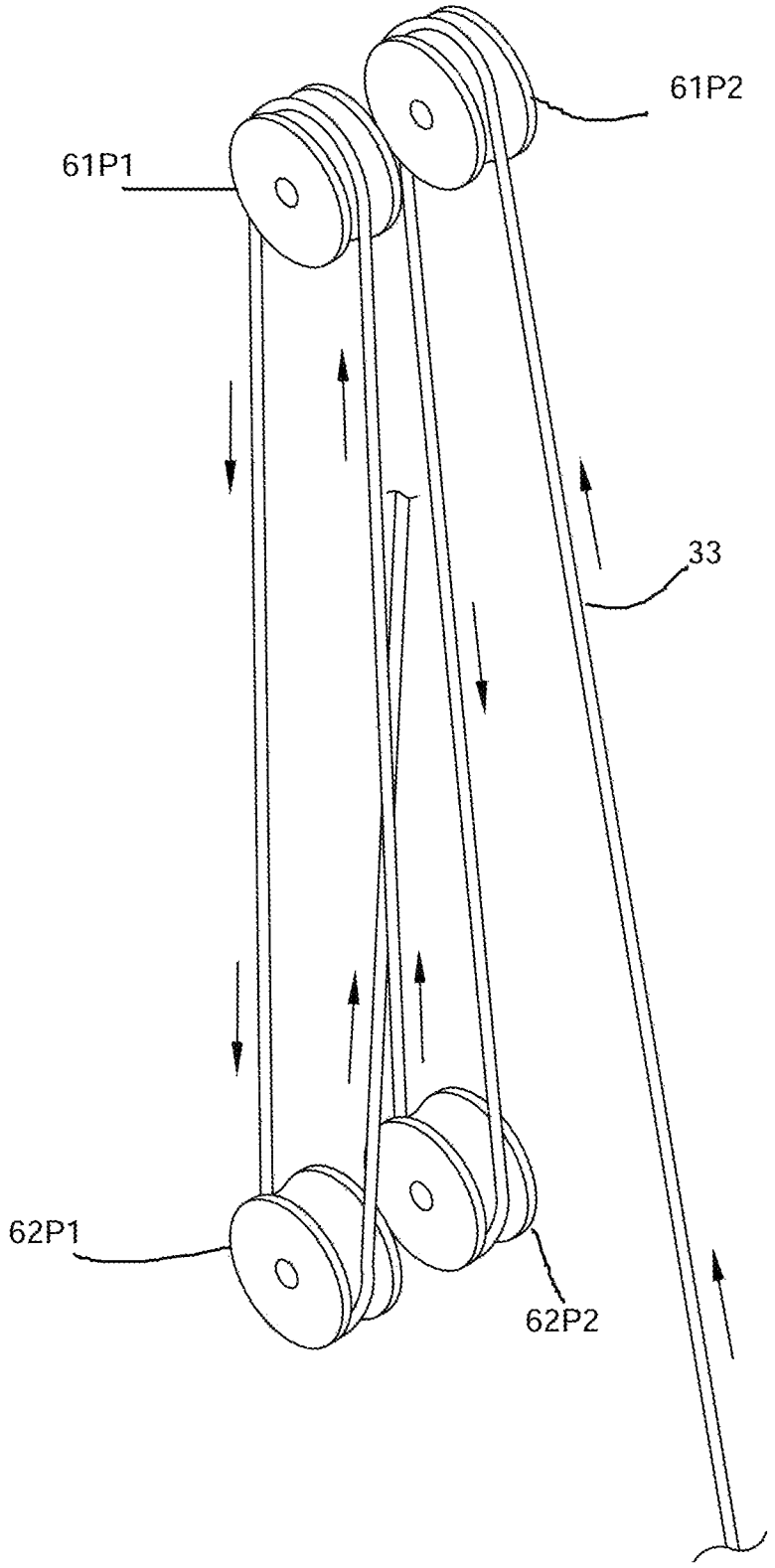
FIG. 11 is a pictorial view of the relative positions of the pulleys and line in accordance with the invention shown in FIG. 6.

Referring also to FIG. 11 there is shown a pictorial view of the relative positions of the pulleys 61P1, 61P2, 62P1, and 62P2 and line in accordance with the invention shown in FIG. 6.

It should be understood that the foregoing description is only illustrative of the invention. Thus, various alternatives and modifications can be devised by those skilled in the art without departing from the invention. Accordingly, the present invention is intended to embrace all such alternatives, modifications and variances that fall within the scope of the appended claims.

The invention claimed is:

1. An umbrella assembly having a fixed upper hub, the umbrella assembly comprising:

a quick release finial, wherein the quick release finial comprises:

a finial top;

a finial tower connected to the finial top;

a non-threaded finial post connected to the final tower, wherein the finial post comprises:

one ball plunger assembly, wherein the one ball plunger assembly comprises:

one spring;

one ball;

a finial insert, wherein the finial insert comprises:

a non-threaded bore hole adapted to snugly receive the finial post;

a bottom surface for engaging the at least one ball plunger assembly;

a pole for wherein the pole comprises a pole bore hole adaptable to receive the finial insert; and a hub slidable on the pole.

2. The umbrella, assembly as in claim 1 further comprising a quick releaser cam cleat assembly, wherein the quick releaser cam cleat assembly comprises:

a stationary bottom grip;

a top grip pivot post;

a top grip cam pivotable on the top grip pivot post;

a rocker min pivot post;

a rocker arm pivotable on the rocker arm pivot post; and wherein the top grip cam and the rocker arm pivot to engage and hold a section of a line between the stationary bottom grip and the top grip cam; and a gravity assist spring for pivoting the rocker arm towards the stationary bottom grip.

3. The umbrella assembly as in claim 2 further comprising a pressure bracket for mounting the quick releaser cam cleat assembly to the slidable hub and wherein the pressure bracket comprises a line retainer.

4. The umbrella assembly as in claim 2 wherein the quick releaser cam cleat assembly further comprises:

a first line guide;

a second line guide, wherein the first and second line guide are coaxial to fully align the line between the top grip cam and the stationary bottom grip.

5. The umbrella assembly as in claim 4 wherein the quick releaser cam cleat assembly further comprises a mounting base for mounting the bottom grip and the rocker arm pivot post.

6. The umbrella assembly as in claim 4 wherein the quick releaser cam cleat assembly further comprises a gravity holding spring.

7. The umbrella assembly as in claim 1 further comprising:

an upper line separator bracket connectable to the fixed upper hub, wherein the upper line separator bracket comprises:

an upper dual pulley bracket; and an upper anti-fouling separator tongue.

8. The umbrella assembly as in claim 1 further comprising:

lower line separator bracket connectable to the slidable hub, wherein the lower line separator bracket comprises:

a lower dual pulley bracket; and a lower anti-fouling separator tongue.

9. The umbrella assembly as claim 1 further comprising the pole, wherein the pole comprises a pole bore hole adaptable to receive the finial insert.

10. An umbrella apparatus, the umbrella apparatus comprising:

an umbrella;

a pole;

a top hub;

a slidable hub having a hole suitable for sliding the slidable hub along the pole;

a plurality of rib members connectable to the umbrella and the top hub;

a plurality of pivotable struts disposed, one-to-one, between the slidable hub and the plurality of rib members;

a finial top adaptable to allow comfortable hand held grasping; and wherein the finial top comprises:

a finial tower connected to the finial top;

a finial post connected to the final tower, wherein the finial post is not threaded and wherein the finial post comprises:

one ball plunger assembly; and a quick releaser cam cleat assembly comprising:

a stationary bottom grip;

a top grip pivot post;

a top grip cam pivotable on the top grip pivot post;

a rocker arm pivot post;

a rocker arm pivotable on the rocker arm pivot post;

a mounting base for mounting the bottom grip and the rocker arm pivot post;

and wherein the top grip cam and the rocker arm pivot to engage and hold a line between the stationary bottom grip and the top grip cam, wherein the line is connected to the slidable hub;

a first line guide;

a second line guide, wherein the first and second line guide are coaxial to fully align the line between the top grip cam and the stationary bottom grip; and a gravity holding spring.

11. The umbrella apparatus as in claim 10 further comprising:

a finial insert, wherein the finial insert comprises:

a bore hole adapted to snugly receive the finial post;

a bottom surface for engaging the at, least one ball plunger assembly; and wherein the pole comprises a bore hole adapted to snugly receive the finial insert.

12. The umbrella apparatus as in claim 10 further comprising:

a plurality of pulleys disposed between the top hub and the slidable hub.

13. The umbrella assembly as in claim 10 wherein the quick releaser cam cleat assembly further comprises a rope leverage surface.

14. An umbrella system, the umbrella system comprising:

an umbrella;

an umbrella pole for supporting the umbrella;

a slidable hub;

a quick releaser cam cleat assembly connectable to the umbrella pole, wherein the quick releaser cam cleat assembly comprises:

a stationary bottom grip;

a top grip pivot post;

a top grip cam pivotable on the top grip pivot post;

a rocker arm pivot, post;

a rocker arm pivotable on the rocker arm pivot post;

a mounting base for mounting the bottom grip and the rocker arm pivot post;

wherein the top grip cam and the rocker arm pivot to engage and hold a line between the stationary bottom grip and the top grip cam, wherein the line is connected to the slidable hub;

a finial top adaptable to allow comfortable hand held grasping and connectable to the umbrella pole; and wherein the finial top comprises:

a finial tower connected to the finial top;

a finial post connected to the final tower, wherein the finial post is not threaded and wherein the finial post comprises:

one ball plunger assembly, wherein the one ball plunger assembly comprises:

one spring;

one ball;

a finial insert, wherein the finial insert comprises:

a non-threaded bore hole adapted to snugly receive the finial post; and a bottom surface for engaging the at least one ball plunger assembly.

15. The umbrella system as in claim 14 wherein the quick releaser cam cleat assembly further comprises:

a first line guide; and a second line guide, wherein the first and second line guide are coaxial to fully align the line between the top grip cam and the stationary bottom grip.

* * * * *